US005746642A

United States Patent [19]

Grapp

[11] Patent Number: 5,746,642

[45] Date of Patent: May 5, 1998

[54] REAR TELEMETRY LIGHT FOR MODEL TRAINS

[76] Inventor: Raymond Grapp, 401 Montgomery Ave., Rockledge, Pa. 19046

[21] Appl. No.: 769,755

[22] Filed: Dec. 20, 1996

[51] Int. Cl.[6] ..... A63H 17/28; H01R 33/22

[52] U.S. Cl. ..... 446/438; 446/485; 362/80

[58] Field of Search ..... 446/438, 485, 446/447, 467; 362/80, 82; 105/1.5, 157.2, 238.2

[56] References Cited

U.S. PATENT DOCUMENTS

| | | | |
|---|---|---|---|
| 1,674,238 | 6/1928 | Becker | 446/438 |
| 2,002,358 | 5/1935 | Smith | 446/438 |
| 4,043,076 | 8/1977 | Potrzuski et al. | 46/228 |
| 4,300,189 | 11/1981 | Shanks | 362/267 |
| 4,360,862 | 11/1982 | Strasser et al. | 362/240 |
| 4,702,476 | 10/1987 | Ostergren | 446/485 |
| 4,772,989 | 9/1988 | Haraden | 362/80 |
| 5,297,484 | 3/1994 | Piserchia et al. | 105/1.5 |

FOREIGN PATENT DOCUMENTS

| | | | |
|---|---|---|---|
| 3038631 | 10/1980 | Germany | 446/438 |

*Primary Examiner*—Michael A. Brown
*Assistant Examiner*—Laura Fossum

[57] ABSTRACT

A rear telemetry light for use in association with a model train kit including a track and a caboose with a rear axle, the apparatus comprises a light assembly comprising a bulb, a bulb cover, a rigid tube and a base including a contact, the rigid tube having an upper end, a lower end and a hollow interior, the bulb cover being positioned upon the upper end of the tube through the aperture in the light housing, a bulb support being positioned within the bulb cover, the bulb including a plurality of power wires electrically coupled thereto, the bulb being positioned within the bulb support, the base including an aperture extending therethrough, the base being positioned within the lower end of the tube, the contact being positioned within the base, the contact being in electrical communication with the power wires, an inner spring being positioned within the hollow interior of the rigid tube, a ground wire being coupled to the base and around an axle of a caboose.

2 Claims, 3 Drawing Sheets

REAR TELEMETRY LIGHT FOR MODEL TRAINS

BACKGROUND OF THE INVENTION

1. Field of the Invention

The present invention relates to a rear telemetry light for model trains and more particularly pertains to providing a realistic looking light source for the rear car of a model train.

2. Description of the Prior Art

The use of miniature lights is known in the prior art. More specifically, miniature lights heretofore devised and utilized for the purpose of decorative adornment are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,221,140 to Oshino discloses miniature lamps.

U.S. Pat. No. 5,367,443 to Hara discloses a miniature lamp.

U.S. Pat. No. 5,278,741 to Ehrman discloses a light bulb assembly particularly useful for miniature lamps.

U.S. Pat. No. 4,369,943 to Hussein discloses a model train crossing gate.

U.S. Pat. No. 4,613,103 to Waranowitz discloses a crossing bell and flasher.

U.S. Pat. Des. No. 280,238 to Hermanson discloses a miniature light bulb.

While these devices fulfill their respective, particular objective and requirements, the aforementioned patents do not describe a rear telemetry light for model trains for providing a realistic looking light source for the rear car of a model train.

In this respect, the rear telemetry light for model trains according to the present invention substantially departs from the conventional concepts and designs of the prior art, and in doing so provides an apparatus primarily developed for the purpose of providing a realistic looking light source for the rear car of a model train.

Therefore, it can be appreciated that there exists a continuing need for new and improved rear telemetry light for model trains which can be used for providing a realistic looking light source for the rear car of a model train. In this regard, the present invention substantially fulfills this need.

SUMMARY OF THE INVENTION

In the view of the foregoing disadvantages inherent in the known types of miniature lights now present in the prior art, the present invention provides an improved rear telemetry light for model trains. As such, the general purpose of the present invention, which will be described subsequently in greater detail, is to provide a new and improved rear telemetry light for model trains and method which has all the advantages of the prior art and none of the disadvantages.

To attain this, the present invention essentially comprises a new and improved rear telemetry light for model trains comprising, in combination: a model train kit including a railroad track and a model train with a caboose, the caboose including an axle, a plurality of wheels and a rear platform, the rear platform including a rear guard, the rear guard being formed in a generally rectangular configuration having an upper support bar, a lower support bar and a plurality of vertical support bars positioned therebetween, the railroad track being electrically powered; a light housing formed in a generally rectangular configuration with a rear wall, two side walls, a top, a bottom, an open front and a hollow interior, the rear wall being coupled to a vertical support bar of the rear guard, the bottom including an aperture extending therethrough; a light assembly comprising a bulb, a bulb cover, a rigid tube including a flexible section and a base including a contact, the rigid tube being fabricated of brass and formed in a generally cylindrical configuration with an upper end, a lower end and a hollow interior, the flexible section being positioned adjacent to its lower end, the flexible section being fabricated of plastic and allowing movement of the upper end of the tube; the bulb cover being fabricated of transparent plastic and formed in a generally oval configuration with an enclosed top and an open bottom, the bulb cover being positioned upon the upper end of the tube through the aperture in the light housing, the bulb cover including a decorative cap fabricated of brass and formed in a generally semispherical configuration with two downwardly extending projection members, the decorative cap being positioned upon the enclosed top of the bulb cover; a bulb support being formed in a generally cylindrical configuration with a center aperture, the bulb support being positioned within the open bottom of the bulb cover, the bulb being formed in a generally cylindrical configuration and including a plurality of power wires electrically coupled thereto, the bulb being positioned within the bulb support; the base being fabricated of plastic and formed as a generally cylindrical shaped upper section and a generally conical shaped lower section, the upper and lower sections including a contiguous aperture extending therethrough, the upper section being positioned within the lower end of the tube, the contact being fabricated of metal and formed as a planar generally circular shaped plate with a cylindrical rod projecting upwardly from the plate, the rod being positioned through the aperture in the upper and lower sections of the base, the contact being in electrical communication with the power wires, the power wires being positioned within the hollow interior of the rigid tube, an inner spring being positioned within the hollow interior of the rigid tube, in an operative orientation the spring urging the contact into communication with the railroad track thereby energizing the bulb; and a ground system comprising a ground wire and a C-clip, the ground wire being coupled to the base, the C-clip being positionable around the axle of the caboose.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rear telemetry light for model trains which has all the advantages of the prior art miniature lights and none of the disadvantages.

It is another object of the present invention to provide a new and improved rear telemetry light for model trains which may be easily and efficiently manufactured and marketed.

It is a further object of the present invention to provide a new and improved rear telemetry light for model trains which is of durable and reliable construction.

An even further object of the present invention is to provide a new and improved rear telemetry light for model trains which is susceptible of a low cost of manufacture with regard to both materials and labor, and which accordingly is then susceptible of low prices of sale to the consuming public, thereby making such a rear telemetry light for model trains economically available to the buying public.

Even still another object of the present invention is to provide a new and improved rear telemetry light for model trains for providing a realistic looking light source for any rear car of a model train.

Lastly, it is an object of the present invention to provide a new and improved rear telemetry light for model trains comprising: a light housing having a top and a bottom including an aperture extending therethrough, the light housing being coupled to a caboose; and a light assembly comprising a bulb, a bulb cover, a rigid tube and a base including a contact, the rigid tube having an upper end, a lower end and a hollow interior, the bulb cover having an enclosed top and an open bottom, the bulb cover being positioned upon the upper end of the tube through the aperture in the light housing, a bulb support being positioned within the open bottom of the bulb cover, the bulb including a plurality of power wires electrically coupled thereto, the bulb being positioned within the bulb support, the base including an aperture extending therethrough, the base being positioned within the lower end of the tube, the contact being positioned within the base, the contact being in electrical communication with the power wires, an inner spring being positioned within the hollow interior of the rigid tube, a ground wire being coupled to the base and around an axle of a caboose.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
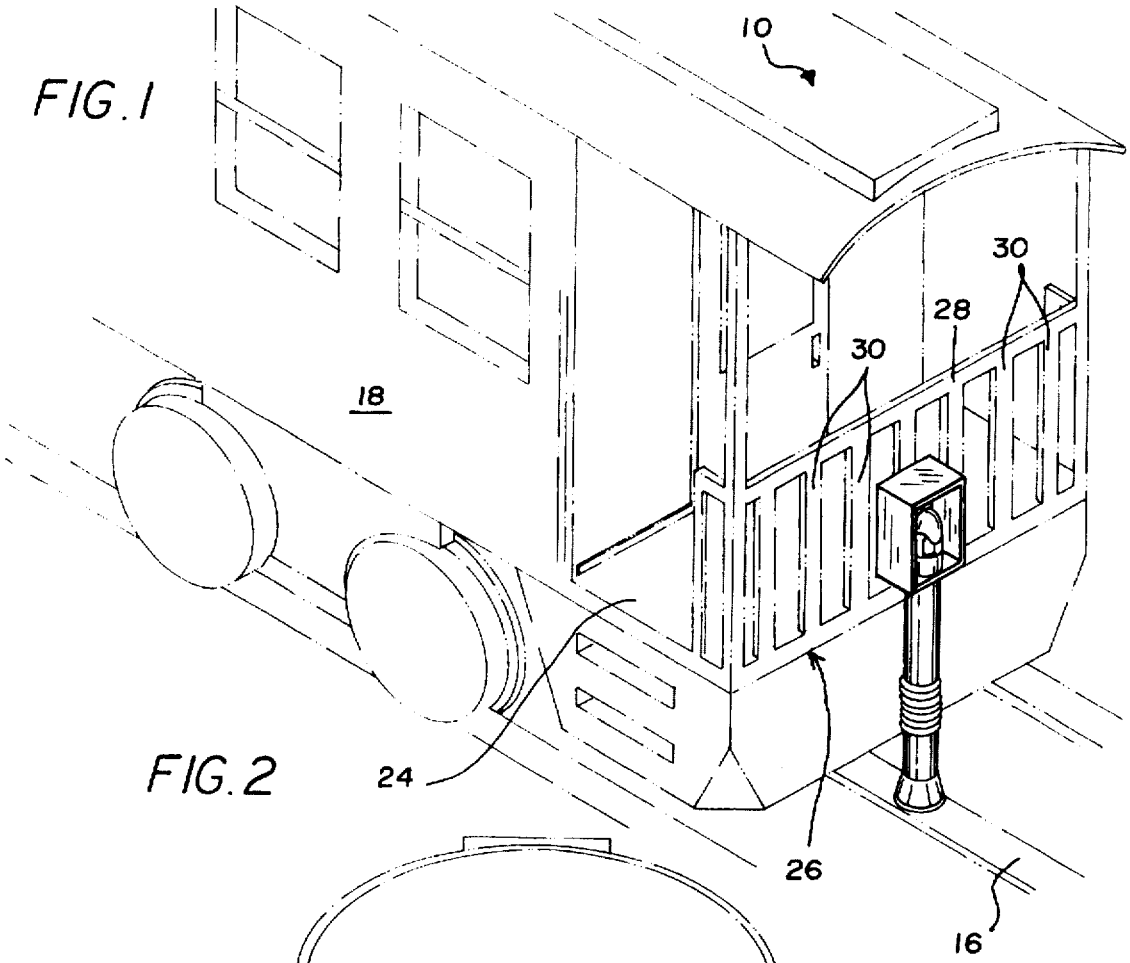
FIG. 1 is a perspective view of the preferred embodiment of the rear telemetry light for model trains constructed in accordance with the principles of the present invention.

With reference now to the drawings, and in particular, to FIG. 1 thereof, the preferred embodiment of the new and improved rear telemetry light for model trains embodying the principles and concepts of the present invention and generally designated by the reference number 10 will be described.

Specifically, it will be noted in the various Figures that the device relates to a new and improved rear telemetry light for model trains 10. In its broadest context, the device consists of a light housing 12 and a light assembly 14. Such components are individually configured and correlated with respect to each other so as to attain the desired objective.

Figure 2:
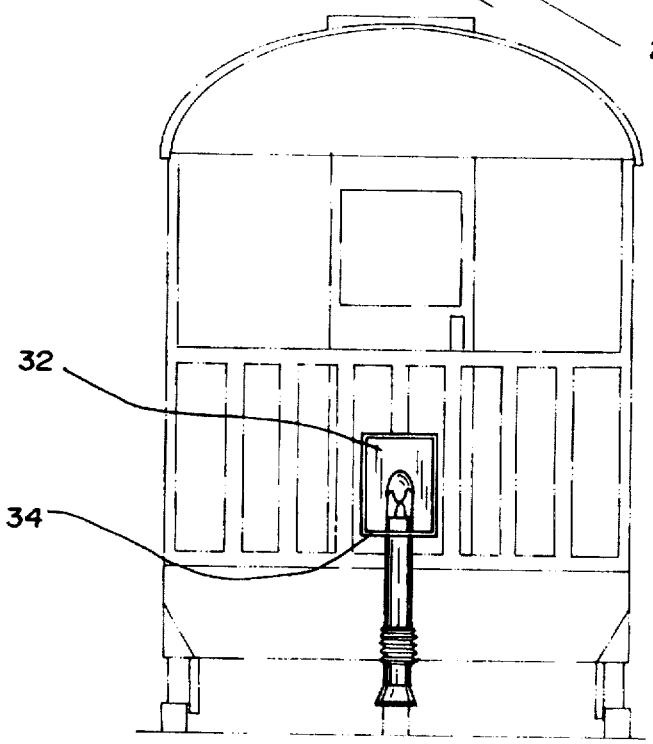
FIG. 2 is a rear perspective view of the apparatus illustration the light.

A model train kit is included with the apparatus. The model train kit includes a railroad track 16 and a model train with a caboose 18. The caboose includes a front axle and a rear axle 20, a plurality of wheels 22 and a rear platform 24. The rear platform includes a rear guard 26. The rear guard is formed in a generally rectangular configuration with an upper support bar 28, a lower support bar and a plurality of vertical support bars 30. The railroad track 16 is electrically powered. Note that in alternate embodiments of the apparatus a model train kit is not included. Rather, the present invention is utilized with an existing model train kit. Note FIGS. 1 and 2.

A light housing 12 is formed in a generally rectangular configuration with a rear wall 32, two side walls, a top, a bottom, an open front and a hollow interior. The rear wall is coupled to a vertical support bar of the rear guard. The bottom 34 includes an aperture extending through it. The light housing functions to support the light assembly and reflects light rearwardly when the bulb is illuminated. Note FIGS. 1 and 2.

Figure 3:
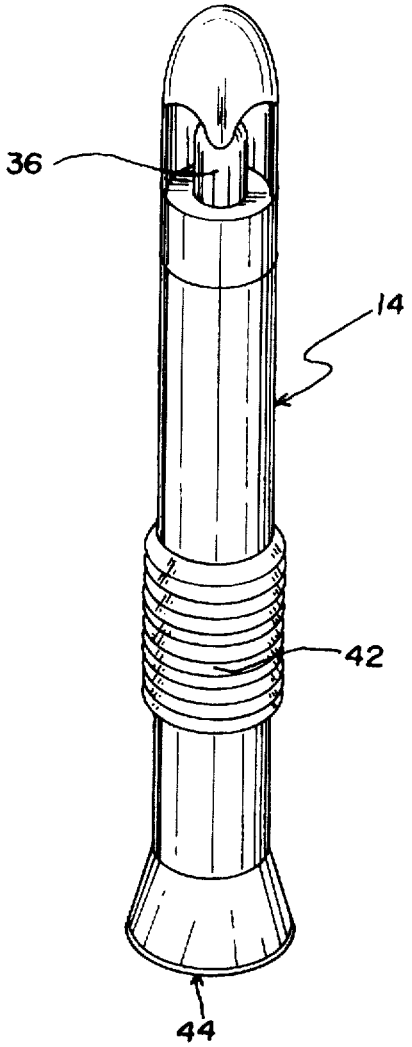
FIG. 3 is a perspective view of the apparatus illustrating the flexible tube.
Figure 4:
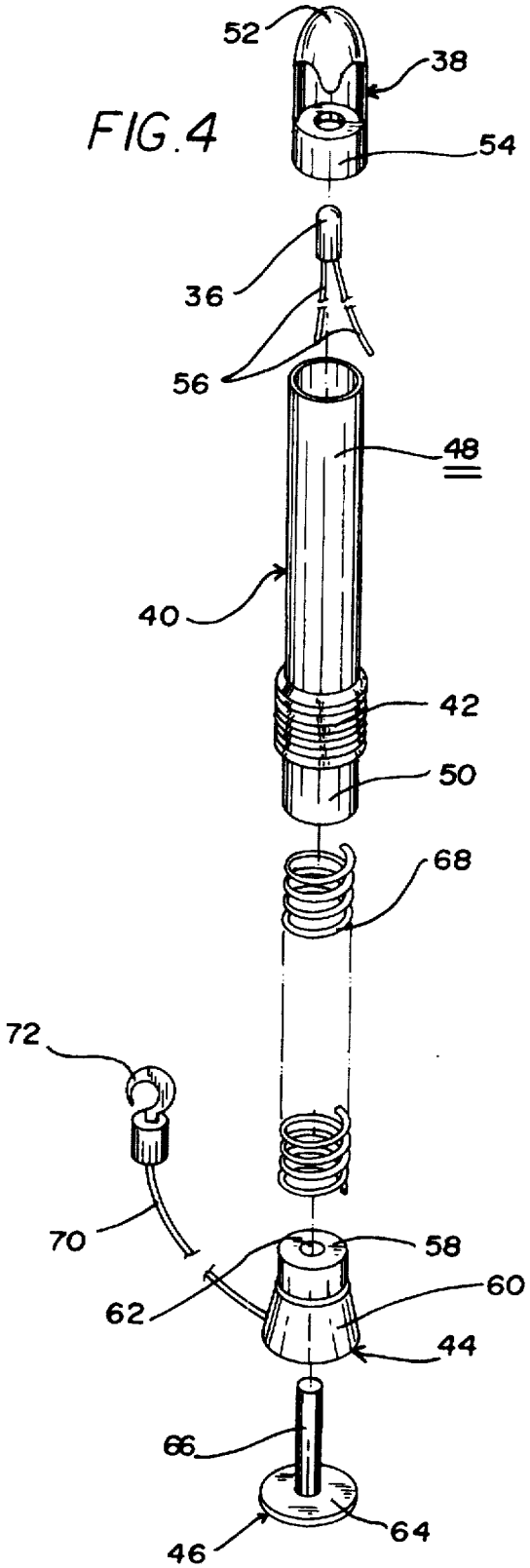
FIG. 4 is a separated perspective view of the apparatus illustrating the positioning of the various components.

The light assembly 14 comprises a bulb 36, a bulb cover 38, a rigid tube 40 with a flexible section 42 and a base 44 having a contact 46. The height of the light assembly is 1 9/16 inches and the diameter is between 1/8 and 1/2 inch in the preferred embodiment. The rigid tube is fabricated of brass and formed in a generally cylindrical configuration with an upper end 48, a lower end 50 and a hollow interior. The flexible section of the tube 42 is positioned adjacent to its lower end 50. The flexible section is fabricated of plastic in the preferred embodiment and allows for movement of the upper end of the tube 48. This configuration provides the apparatus with the flexibility required for the tube to maintain constant electrical communication with the track. Note FIGS. 3 and 4.

The bulb cover 38 is fabricated of transparent plastic and formed in a generally oval configuration with an enclosed top and an open bottom. The bulb cover is positioned upon the upper end of the tube through the aperture in the light housing. The bulb cover includes a decorative cap 52 fabricated of brass and formed in a generally semispherical configuration with two downwardly extending projection members. The decorative cap is positioned upon the enclosed top of the bulb cover. Note FIGS. 3 and 4.

Figure 5:
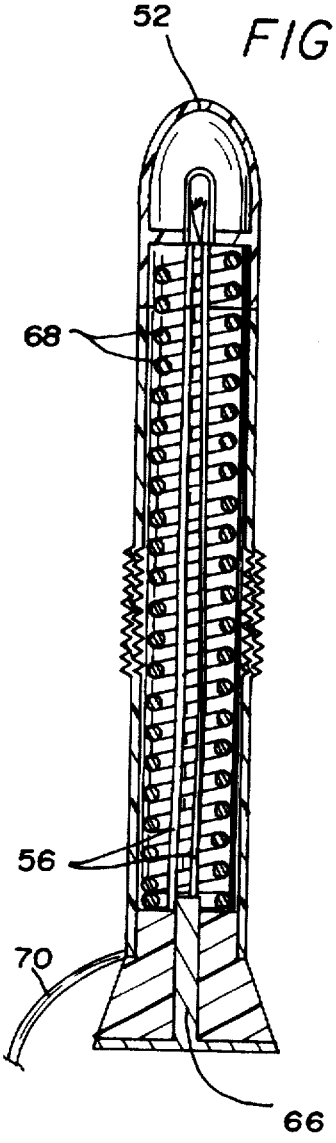
FIG. 5 is a cross-sectional view of the rear telemetry light of the present invention.

A bulb support 54 is formed in a generally cylindrical configuration with a center aperture. The bulb support is positioned within the open bottom of the bulb cover. The bulb 36 is formed in a generally cylindrical configuration and includes a plurality of power wires 56 electrically coupled to the bulb. The bulb is positioned within the bulb support. Note FIGS. 3–5.

The base 44 is fabricated of plastic in the preferred embodiment and is formed as a generally cylindrical shaped upper section 58 and a generally conical shaped lower section 60. The upper and lower sections include a contiguous aperture 62 extending through them. The upper section is positioned within the lower end of the tube. Note FIGS. 3–5.

The contact 46 is fabricated of metal and formed as a planar generally circular shaped plate 64 with a cylindrical rod 66 projecting upwardly from the plate. In alternate embodiments of the apparatus a thumbtack could be utilized in place of the contact. The rod is positioned through the aperture in the upper and lower sections of the base. The contact is in electrical communication with the power wires 56. The power wires are positioned within the hollow interior of the rigid tube. An inner spring 68 is positioned within the hollow interior of the rigid tube. In the preferred embodiment of the apparatus the inner spring is similar to a conventional pen spring. In an operative orientation the spring urges the contact into communication with the center rail of the model railroad track thereby energizing the bulb. This causes the bulb to illuminate so that users are aware of the rear of the train to avoid an accident, a safety feature for the apparatus. The present invention also provides a sense of realism for model train enthusiasts. Note FIGS. 1–5.

Figure 6:
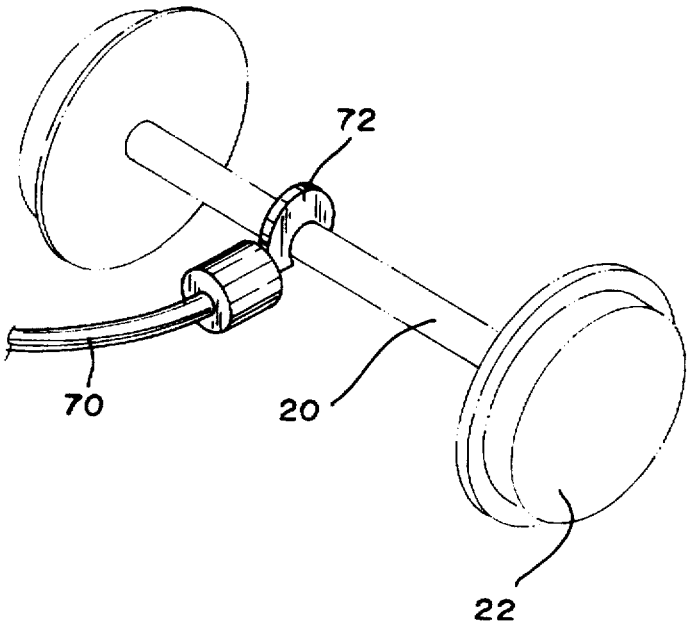
FIG. 6 is a perspective view of the C-clip of the present invention.

A ground system comprises a ground wire 70 and a C-clip 72. The ground wire is coupled to the base. The C-clip is positionable around the axle of the caboose. The ground assembly provides an electrical ground for the light assembly. Note FIGS. 5 and 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A rear telemetry light for use in association with a model train kit including a track and a caboose with a rear axle, the apparatus comprising in combination:

a light housing having a top and a bottom including an aperture extending therethrough, the light housing being coupled to a caboose;

a light assembly comprising a bulb, a bulb cover, a rigid tube and a base including a contact, the rigid tube having an upper end, a lower end and a hollow interior, the rigid tube includes a flexible section positioned adjacent to its lower end, the flexible section being fabricated of plastic and allowing movement of the upper end of the tube, the bulb cover having an enclosed top and an open bottom, the bulb cover being positioned upon the upper end of the tube through the aperture in the light housing, a bulb support being positioned within the open bottom of the bulb cover, the bulb including a plurality of power wires electrically coupled thereto, the bulb being positioned within the bulb support, the base including an aperture extending therethrough, the base being positioned within the lower end of the tube, the contact being positioned within the base, the contact being in electrical communication with the power wires, an inner spring being positioned within the hollow interior of the rigid tube, a ground wire being coupled to the base and around an axle of the caboose;

the contact is fabricated of metal and formed as a planar generally circular shaped plate with a cylindrical rod projecting upwardly from the plate, the rod being positioned through the aperture in the upper and lower sections, and the inner spring in an operative orientation urging the contact into communication with the railroad track thereby energizing the bulb; and the bulb cover includes a decorative cap fabricated of brass and formed in a generally semi-spherical configuration with two downwardly extending projection members, the decorative cap being positioned upon the enclosed top of the bulb cover.

2. A new and improved rear telemetry light for model trains comprising, in combination:

a model train kit including a railroad track and a model train with a caboose, the caboose including an axle, a plurality of wheels and a rear platform, the rear platform including a rear guard, the rear guard being formed in a generally rectangular configuration having an upper support bar, a lower support bar and a plurality of vertical support bars positioned therebetween, the railroad track being electrically powered;

a light housing formed in a generally rectangular configuration with a rear wall, two side walls, a top, a bottom, an open front and a hollow interior, the rear wall being coupled to a vertical support bar of the rear guard, the bottom including an aperture extending therethrough;

a light assembly comprising a bulb, a bulb cover, a rigid tube including a flexible section and a base including a contact, the rigid tube being fabricated of brass and formed in a generally cylindrical configuration with an upper end, a lower end and a hollow interior, the flexible section being positioned adjacent to its lower end, the flexible section being fabricated of plastic and allowing movement of the upper end of the tube;

the bulb cover being fabricated of transparent plastic and formed in a generally oval configuration with an enclosed top and an open bottom, the bulb cover being positioned upon the upper end of the tube through the aperture in the light housing, the bulb cover including a decorative cap fabricated of brass and formed in a generally semispherical configuration with two downwardly extending projection members, the decorative cap being positioned upon the enclosed top of the bulb cover;

a bulb support being formed in a generally cylindrical configuration with a center aperture, the bulb support being positioned within the open bottom of the bulb cover, the bulb being formed in a generally cylindrical configuration and including a plurality of power wires electrically coupled thereto, the bulb being positioned within the bulb support;

the base being fabricated of plastic and formed as a generally cylindrical shaped upper section and a generally conical shaped lower section, the upper and lower sections including a contiguous aperture extending therethrough, the upper section being positioned within the lower end of the tube, the contact being fabricated of metal and formed as a planar generally circular shaped plate with a cylindrical rod projecting upwardly from the plate, the rod being positioned through the aperture in the upper and lower sections of the base, the contact being in electrical communication with the power wires, the power wires being positioned within the hollow interior of the rigid tube, an inner spring being positioned within the hollow interior of the rigid tube, in an operative orientation the spring urging the contact into communication with the railroad track thereby energizing the bulb; and a ground system comprising a ground wire and a C-clip, the ground wire being coupled to the base, the C-clip being positionable around the axle of the caboose.

* * * * *